United States Patent [19]

Beranek et al.

[11] 4,417,923

[45] Nov. 29, 1983

[54] SOLID REFINING AGENTS FOR THE REFINING OF ALUMINUM AND ALLOYS THEREOF AND METHOD OF PREPARING SAID AGENTS

[75] Inventors: Ivan Beranek; Josef Kyral; Miroslav Uhlir; Ivan Zlesak, all of Usti nad Labem, Czechoslovakia

[73] Assignee: Spolek pro chemickou a hutni vyrobu, narodni podnik, Usti nad Labem, Czechoslovakia

[21] Appl. No.: 417,212

[22] Filed: Sep. 13, 1982

[30] Foreign Application Priority Data

Sep. 14, 1981 [CS] Czechoslovakia ..... 6752-81

[51] Int. Cl.[3] ..... C22B 21/06

[52] U.S. Cl. ..... 75/257; 75/68 R; 75/93 AC; 75/93 G; 264/122

[58] Field of Search ..... 75/257, 93 AC, 93 E, 75/68 R; 264/122

[56] References Cited

U.S. PATENT DOCUMENTS

| | | | |
|---|---|---|---|
| 2,654,670 | 10/1953 | Davis et al. | 75/257 |
| 3,144,323 | 8/1964 | Watson et al. | 75/68 R |
| 3,769,001 | 10/1973 | Valdo et al. | 75/68 R |
| 3,933,476 | 1/1976 | Chopra et al. | 75/257 |

FOREIGN PATENT DOCUMENTS

| | | | |
|---|---|---|---|
| 52-23514 | 2/1977 | Japan | 75/93 E |
| 631553 | 11/1978 | U.S.S.R. | 75/93 AC |

*Primary Examiner*—M. J. Andrews

[57] ABSTRACT

Method of preparing solid refining agents for the refinement of molten aluminum as well as alloys thereof, and the product of such method. The method comprises a perfect homogenization of components of the agent comprising hexachlorobenzene and a mixture of inorganic salts which latter are dried so as to have a moisture content of 1% by weight of water at most. An amount of from 0.05 to 10 kilograms of discrete bodies of such homogenized mixture is exposed then to a preferably isotactic pressure of from 5 to 150 MPa to form bodies possessing sufficient mechanical strength so as to facilitate the manipulation of the agent and the application thereof into the molten metal. The resulting refining agent is in the form allowing a rational utilization thereof with a high refinement efficiency which is produced by the progressive decomposition of the agent accompanied by the development of chlorine acting as the actual refining agent as well as of other agent constituents to modify its refining effect. The refining agent of the invention also contributes to an improvement of work hygiene, since the bodies of refining agent can be wrapped in aluminum foils.

4 Claims, No Drawings

SOLID REFINING AGENTS FOR THE REFINING OF ALUMINUM AND ALLOYS THEREOF AND METHOD OF PREPARING SAID AGENTS

The invention relates to solid refining agents for the refining of molten aluminum and alloys thereof, and to a method of preparing such agents.

As is known, there exist many processes of removing unwanted admixtures from molten aluminum, such as blowing neutral gases through the melt, letting the melt settle, filtering, and so forth. Preferably, there are employed solid refining agents for the refining, such agents decomposing in molten metal or alloys thereof while developing chlorine which constitutes the cleaning agent proper. Such agents contain, as a rule, some other substances which positively influence the refining process. In the cleaning process, it is necessary to remove gases such as, above all, hydrogen, and also to remove non-metallic inclusions such as alumina and other impurities. Such undesirable admixtures are dispersed throughout the entire volume of molten metal, and have to be separated therefrom in the form of slag which tends to float up to the surface of the melt. This is why the refining agent must be applied to the entire volume of the molten metal as, for instance, by means of refining baskets. The agent should be prevented from floating up to the surface of the molten metal since otherwise it would decompose, and liberated chlorine would escape uselessly to the atmosphere and pollute the environment. For industrial applications, it is necessary to put the solid refining agent into the form which is suitable for such purpose.

The heretofore applied forms of refining agents have some disadvantages. The actual refining agent at the instant of its action usually has a gaseous form and the cleaning effects thereof are carried out by its individual bubbles. It is therefore advantageous to produce as small bubbles as possible, and also to distribute them throughout the volume of the molten metal as perfectly as possible. This, however, in the case of using inert gases (e.g. nitrogen, argon) requires the use of expensive systems, and places relatively high importance on the purity of such media. Moreover, the manipulation of media which are sometimes considerably toxic (e.g. chlorine) is very troublesome.

From this point of view, it is more advantageous to make use of solid refining agents which are added to molten metal where they decompose while producing fine bubbles (usually chlorine) so that their effectiveness is high. The manipulation of solid refining agents as well is easier than that of gaseous media. However, solid refining agents have to be applied in a form which allows a rational use thereof; this means in the form of discrete particles having a weight of from 0.05 to 10 kgs so as to permit them to be easily manipulated. Apart from this, they have to posses a sufficient mechanical strength to prevent them from decomposing too quickly and all at once, but also to provide for their successive decomposition on their surfaces. On the other hand, the refining agent must not be too compact, since otherwise its decomposition takes place too slowly and substantially extends the time necessary to complete the refining process. The hitherto used refining agents have been applied in a powder or pellet form.

A satisfactory form of the refining agent has to be mechanically strong in order to be resistant to destruction, and to resist too vigorous decomposition in the refining process whereby the process would be adversely affected and the refining effect would be too low. Hitherto known solid refining agents do not quite meet the criteria for highly efficient refining agents.

The disadvantages of the prior art as hereinabove set forth are eliminated by the refining agent and method of preparing the same of the present invention. Such refining agent, for the refining of aluminum and its alloys, is in a solid, pellet form.

In a preferred embodiment of the method in accordance with the invention hexachlorobenzene is mixed with alkali metal chlorides in a weight ratio of 1:0.05 to 3, such alkali metal chloride being preferably potassium chloride, or potassium and sodium chlorides in a ratio of 1:1. The mixture is dried so as to have a maximum moisture content of 1% by weight of water, and thereafter the mixture is homogenized and an amount thereof of from 0.05 to 10 kilograms thereof is subjected to a pressure of from 5 to 150 MPa, preferably 20 to 80 MPa.

Alternatively, the mixture can be homogenized together with an additive of up to 20% by weight of fluxing agents selected from the group consisting of potassium fluoride, sodium fluoride, potassium hexafluoroaluminate, and sodium hexafluoroaluminate, such fluxing agent having a maximum moisture content of 1% by weight of water.

In accordance with a preferred embodiment of the invention, the mixture is homogenized together with an additive of up to 40% by weight of refining admixtures selected from the group consistinng of sodium and/or potassium complex fluorides of titanium, boron, zirconium, metallic titanium, alloys of aluminum wit titanium and/or boron, alloys of aluminum with zirconium as well as mixtures thereof having a maximum water content of 1% by weight.

The desired characteristics in the entire refining agent can preferably be obtained so that the mixture is exposed to an equal pressure in all directions of from 20 to 80 MPa.

In order to provide for beneficial hygienic conditions in the manipulation of and actual use of the agent, the pressurized or compressed mixture, after pressure release, is wrapped in an aluminum foil.

Refining agents prepared in the process according to the invention in the form of pellets or individual bodies each having a weight of from 0.05 to 10 kgs posses a plurality of advantages. They are sufficiently strong so that their transportation and manipulation are easily carried out. In the actual refining process, they decompose at a speed which is satisfactory from the viewpoint of both effectiveness as well as the time which they require to perform a complete refining of the metal. The active agent component has a relatively low vapor tension of $1.43\times10^{-3}$ MPa at 20 degrees C. so that the contamination of the work environment is reduced. Apart from this, it is advantageous to wrap the product in aluminum foil so that the safety of the work and its hygiene are additionally enhanced since the refining agent can be immediately added to the molten metal without the necessity of removing the aluminum foil wrapper therefrom.

The following examples are given as illustrative only without, however, limiting in any way the scope of the invention.

EXAMPLE 1

400 kgs of hexachlorobenzene was added to a mixing apparatus by sifting it through a 3 mm mesh diameter sieve. 50 kgs of crystalline potassium chloride and 50 kgs of crystalline sodium choride were similarly sifted and introduced into the mixing apparatus. All of such ingredients had been previously dried to have their moisture content less than 1% by weight of water. After homogenization of the mixture it was poured into cylindrical rubber molds, one kilogram of the mixture to each mold. After the molds had been sealed and put in a protective basket they were exposed to a pressure by means of an isotactic press which subjected the mixture to equal pressure in all directions. The pressure exerted by the press was raised at the rate of 10 MPa per minute up to a maximum value of 50 MPa. When the pressure had reached this maximum value, the rise in pressure was stopped for 0.5 minute and then the pressure was dropped at a speed of 15 MPa per minute down to atmospheric pressure.

There were obtained pellets of the refining agent having a compressive strength of 20 MPa, such pellets being used for the refining of raw molten aluminum. In such application they proved to have the desired characteristics, which means that they were sufficiently strong, coherent, their decomposition took place at a sufficient speed on their surfaces while developing fine chlorine bubbles. The refinement time was reduced by 15% as compared with conventional processes, and the consumption of the refining agent dropped while maintaining results of the process which were comparable to those of conventional processes.

EXAMPLE 2

200 kgs of hexachlorobenzene, 50 kgs of crystalline potassium chloride, 40 kgs of crystalline sodium chloride, and 10 kgs of technical sodium fluoroaluminate were sifted through a 3 mm mesh diameter sieve and introduced into a mixing apparatus. Such ingredients were dried and homogenized. The mixture was poured into rubber molds (having a 3 mm wall thickness), 5 kgs of the mixture being introduced into each mold. After the molds had been sealed and put in a protective basket the contents were pressed in an isostatic press. The pressure to which the molds were subjected was raised at the rate of 20 MPa per minute up to the final maximum value of 70 MPa, after which such pressure was reduced at a rate of 25 MPa per minute down to atmospheric pressure.

There was obtained a refining agent in the form of cylindrical bodies each having a weight of 5 kgs the bodies then being wrapped in aluminum foil and employed for the refining of aluminum together with 5% by weight of each body of refining agent of magnesium. In such an application, the refining agent proved to possess the required characteristics: it had a sufficient compressive strength to 25 MPa, was coherent, the bodies of refining agent did not disintegrate but decomposed on their surfaces. The refining process was sufficiently effective, since chlorine was developed in the form of fine bubbles and was uniformly distributed throughout the volume of the molten metal being refined. The skimmings obtained from the top of the molten metal were easily separated from the metal, were dry and bulky and had a low aluminum percentage content. When compared with conventional processes, the hygienic conditions under which refining in accordance with the present invention was carried out were substantially proved due to the fact that the bodies of the refining agent were wrapped in aluminum foil when added to the melt of metal being refined.

EXAMPLE 3

200 kgs of hexachlorobenzene, 50 kgs of crystalline potassium chloride, 20 kgs of sodium chloride, 20 kgs of calcium difluoride, 20 kgs of potassium tetrafluoroborate and 30 kgs of potassium hexafluorotitanate were sifted through a 4 mm mesh diameter sieve and disposed in a mixing apparatus. All of such ingredients were dried so as to have a constant weight. The mixture was homogenized and pressed in an isostatic press under a pressure of 100 MPa to form pellets each having a weight of 3 kgs and a compressive strength of 22 MPa. In this form, the refining agent was used for the refining of raw aluminum. When so used in the refining process, it proved to be coherent, its decomposition took place on the surface of the pellets or refining bodies at a sufficient speed so that the refining time was reduced by 10% when compared with the conventional process. Also, the quality of the refined metal was higher than that which resulted from the conventional refining process.

Although the invention is illustrated and described with reference to a plurality of embodiments, it is to be expressly understood that it is in no way limited to the disclosure of such preferred embodiments but is capable of numerous modifications within the scope of the appended claims.

We claim:

1. A method of preparing solid refining agents in the form of discrete bodies for the refinement of aluminum and alloys thereof by adding such bodies to a melt of such metals, said method comprising mixing of completely chlorinated hydrocarbon and at least one alkali metal chloride selected from the group consisting of sodium chloride and potassium chloride and exposing this mixture to pressure, said chlorinated hydrocarbon in the mixture with an alkaline chloride being hexachlorbenzene and the pressing being performed by exerting a pressure from 20 to 110 MPa to an amount of 0.05 to 10 kg of the mixture.

2. A method as in claim 1, the pressing being performed by a pressure 20 to 70 MPa.

3. A method as in claim 2, the pressing being performed by action of isostatic pressure.

4. A solid refining agent in the form of a discrete body, said agent adapted for refining of aluminum and of its alloys, said body having a weight from 0.05 to 10 kilograms, being coherent and self-sustaining, and having a compressive strength of at least 20 MPa, said refining agent being composed of a mixture of hexachlorbenzene with at least one alkali metal chloride in a weight ratio of 1:0.05 to 3, said alkali metal chloride being selected from the group consisting of sodium chloride and potassium chloride.

* * * * *